US011008929B2

(12) United States Patent
Fujita et al.

(10) Patent No.: US 11,008,929 B2
(45) Date of Patent: May 18, 2021

(54) ENGINE COOLING APPARATUS

(71) Applicant: Mazda Motor Corporation, Hiroshima (JP)

(72) Inventors: Takayoshi Fujita, Hiroshima (JP); Takafumi Nishio, Otake (JP); Kouichi Miyamoto, Hiroshima (JP); Tatsuya Takahata, Hiroshima (JP); Yasushi Nakahara, Higashihiroshima (JP); Akihiro Noda, Hatsukaichi (JP)

(73) Assignee: Mazda Motor Corporation, Hiroshima (JP)

( * ) Notice: Subject to any disclaimer, the term of this patent is extended or adjusted under 35 U.S.C. 154(b) by 0 days.

(21) Appl. No.: 16/479,451

(22) PCT Filed: Feb. 21, 2018

(86) PCT No.: PCT/JP2018/006253
§ 371 (c)(1),
(2) Date: Jul. 19, 2019

(87) PCT Pub. No.: WO2018/155499
PCT Pub. Date: Aug. 30, 2018

(65) Prior Publication Data

US 2019/0376439 A1 Dec. 12, 2019

(30) Foreign Application Priority Data

Feb. 21, 2017 (JP) ..... JP2017-030331

(51) Int. Cl.
*F01P 7/14* (2006.01)
*F01P 7/16* (2006.01)
*F01P 3/20* (2006.01)

(52) U.S. Cl.
CPC ..... *F01P 7/16* (2013.01); *F01P 3/20* (2013.01); *F01P 2025/50* (2013.01);
(Continued)

(58) Field of Classification Search
CPC .. F01P 7/16; F01P 3/20; F01P 2025/50; F01P 2037/02; F01P 2060/04; F01P 2060/08
(Continued)

(56) References Cited

U.S. PATENT DOCUMENTS 4,369,738 A * 1/1983 Hirayama ..... F01P 7/165 123/41.1
4,381,736 A * 5/1983 Hirayama ..... F01P 7/164 123/41.1

(Continued)

FOREIGN PATENT DOCUMENTS

FR WO2011051618 * 5/2011 ..... F01P 7/16
JP H1182014 A 3/1999
WO 2011/051618 A1 5/2011

OTHER PUBLICATIONS

European Patent Office, Extended European Search Report Issued in Application No. 18757690.5 dated Oct. 1, 2019, Germany, 10 pages.

*Primary Examiner* — Hung Q Nguyen
*Assistant Examiner* — Anthony Donald Taylor, Jr.
(74) *Attorney, Agent, or Firm* — Alleman Hall Creasman & Tuttle LLP

(57) ABSTRACT

Provided is an engine cooling apparatus capable of preventing deterioration in reliability of a cylinder head of an engine during cold engine operation. The engine cooling apparatus comprises an engine cooling water path, a heater core cooling path, and a radiator cooling water path, and further comprises a switching valve for switching among these cooling water paths. The switching valve is operable, when the temperature of an area around an exhaust valve is raised to a value greater than, e.g., 150° C., even in a situation where the temperature of cooling water for cooling the
(Continued)

engine is equal to or less than, e.g., 50° C., to switch from the in-engine cooling water path to the heater core cooling water path.

8 Claims, 6 Drawing Sheets

(52) U.S. Cl.
CPC ..... *F01P 2037/02* (2013.01); *F01P 2060/04* (2013.01); *F01P 2060/08* (2013.01)

(58) Field of Classification Search
USPC ..... 123/41.1
See application file for complete search history.

(56) References Cited

U.S. PATENT DOCUMENTS 4,768,484 A * 9/1988 Scarselletta ..... F01P 3/22 123/41.21
5,121,714 A * 6/1992 Susa ..... F01P 7/165 123/41.1
5,970,927 A * 10/1999 Suzuki ..... F01P 3/20 123/41.05
6,178,928 B1 * 1/2001 Corriveau ..... F01P 7/048 123/41.12
6,321,696 B1 * 11/2001 Nishioka ..... F01P 11/16 123/41.15
6,539,899 B1 * 4/2003 Piccirilli ..... F01P 7/167 123/41.08
6,920,845 B2 * 7/2005 Lelkes ..... F01P 7/167 123/41.01
7,886,988 B2 * 2/2011 Schwartz ..... F01P 7/167 237/12.3 R
8,201,525 B2 * 6/2012 Shiobara ..... F01P 7/167 123/41.01
8,757,110 B2 * 6/2014 Triebe ..... F01P 7/14 123/41.1
9,562,492 B2 * 2/2017 Nomura ..... F02F 1/16
10,287,968 B2 * 5/2019 Kaneko ..... F01P 7/14
2016/0376977 A1 * 12/2016 Watanabe ..... F01P 5/12 123/41.08

* cited by examiner

Engine speed (rpm)
Charging efficiency (in-cylinder air amount)
Fuel injection amount
Ignition timing Generated heat amount Distribution of heat amount
(Cylinder block, cylinder head)

ENGINE COOLING APPARATUS

TECHNICAL FIELD

The present invention relates to an engine cooling apparatus, and more particularly to an engine cooling apparatus configured such that the flow of cooling water for cooling an engine is switched among a plurality of cooling water paths by a switching valve.

BACKGROUND ART

Heretofore, a vehicle has been provided with an engine cooling apparatus configured to absorb heat released from an engine by cooling water and utilize part of the absorbed heat as a heat source of, e.g., a heater core for heating the inside of a passenger compartment of the vehicle.

One example of such an engine cooling apparatus is described in the following Patent Document 1. This conventional engine cooling apparatus comprises an external cooling water passage (cooling water path) for leading cooling water for cooling an engine, to a radiator and a heater core therethrough, wherein a radiator flow control valve and a heater core flow control valve are provided to block and stop respective flows of the cooling water toward the radiator and the heater core.

The conventional engine cooling apparatus is configured such that: when the temperature of the cooling water is equal to or less than 45° C., the two flow control valves are closed to cause the cooling water to circulate through the engine; when the temperature of the cooling water is in the range of 45° C. to less than 82° C., the heater core flow control valve is opened while the radiator flow control valve is kept in the closed state, thereby leading the cooling water to the heater core; and, when the temperature of the cooling water is equal to or greater than 82° C., the radiator flow control valve is opened, and the heater core flow control valve is closed, thereby leading the cooling water to the radiator.

PRIOR ART DOCUMENT

Patent Document

Patent Document 1: JP H11-082014A

SUMMARY OF INVENTION

Technical Problem

During a cold engine operation such as at start-up of the engine, the temperature of the cooling water is relatively low. Thus, the above conventional engine cooling apparatus is configured to, when the temperature of the cooling water is equal to or less than a given value (e.g., 45° C.), circulate the cooling water through the engine, as mentioned above, so as to raise the temperature of the cooling water. However, even during the cold engine operation in which the temperature of the cooling water is equal to or less than a given value, particularly in a situation where the temperature of the cooling water has a minus value at start-up of the engine, the temperature of a cylinder head of the engine is raised to becomes high temperature, whereas a cylinder block of the engine is maintained at a relatively low temperature due to the cooling water having such a low temperature. As a result, the cylinder head is thermally deformed (expanded) largely as compared with the cylinder block, and the entire engine is deformed into an inverted trapezoidal shape, leading to deterioration in reliability of the cylinder head, in some cases. The present inventors found such a problem during cold engine operation, and diligently conducted researches to solve this problem.

Therefore, the present invention has been made to solve the above conventional problem, and an object thereof is to provide an engine cooling apparatus capable of preventing deterioration in reliability of a cylinder head of an engine during cold engine operation.

Solution to Technical Problem

In order to achieve the above object, the present invention provides an engine cooling apparatus which comprises: a first cooling water path for circulating cooling water for cooling an engine through the engine; a second cooling water path for circulating the cooling water through the engine and a heat exchanger outside the engine; a switching valve for switching a flow of the cooling water between the first cooling water path and the second cooling water path; switching control means operable, when a temperature of the cooling water is equal to or less than a first setup value, to control the switching valve to switch the flow of the cooling water to the first cooling water path, and, when the temperature of the cooling water is greater than the first setup value, to control the switching valve to switch the flow of the cooling water to the second cooling water path. The engine cooling apparatus is characterized in that it further comprises exhaust valve area temperature detection means operable to detect or estimate a temperature of an exhaust valve area around an exhaust valve of the engine, wherein the switching control means is operable, when the temperature of the exhaust valve area detected by the exhaust valve area temperature detection means is greater than a given temperature, in a state in which the switching valve is switched to the first cooling water path, to control the switching valve to switch the flow of the cooling water to the second cooling water path.

In the engine cooling apparatus of the present invention having the above feature, when the temperature of the exhaust valve area is greater than the given temperature, in the state in which the switching valve is switched to the first cooling water path, the switching control means operates to control the switching valve to switch the flow of the cooling water to the second cooling water path. Thus, in the engine cooling apparatus of the present invention, even in a situation where the temperature of the exhaust valve area becomes a higher temperature than the given temperature, during cold engine operation in which the cooling water flows through the first cooling water path, the cooling water can be controlled to flow through the second cooling water path, so that it is possible to cool the cooling water through the heat exchanger in the second cooling water path. This makes it possible to suppress a temperature rise in the exhaust valve area, thereby preventing deterioration in reliability of the engine.

Preferably, in the engine cooling apparatus of the present invention, the second cooling water path comprises: a heater core cooling water path for circulating the cooling water between the engine and a heater core; and a radiator cooling water path for circulating the cooling water between the engine and a radiator, wherein the switching control means is operable, when the temperature of the exhaust valve area detected by the exhaust valve area temperature detection means is greater than the given temperature, in the state in which the switching valve is switched to the first cooling water path, to control the switching valve to switch the flow of the cooling water to the heater core cooling water path.

According to this feature, when the temperature of the exhaust valve area is greater than the given temperature, in the state in which the switching valve is switched to the first cooling water path, the switching control means operates to control the switching valve to switch the flow of the cooling water to the heater core cooling water path. Thus, even in the situation where the temperature of the exhaust valve area becomes a higher temperature than the given temperature, during the cold engine operation in which the cooling water flows through the first cooling water path, the cooling water can be controlled to flow through the heater core cooling water path, so that it is possible to cool the cooling water in the heater core cooling water path. This makes it possible to suppress a temperature rise in the exhaust valve area, thereby preventing deterioration in reliability of the engine.

More preferably, in the above engine cooling apparatus, the switching control means is operable: when the temperature of the cooling water is equal to or less than the first setup value, to control the switching valve to switch the flow of the cooling water to the first cooling water path; when the engine cooling water temperature is greater than the first setup value, and equal to or less than a second setup value greater than the first setup value, to control the switching valve to switch the flow of the cooling water to the heater core cooling water path; and, when the temperature of the cooling water is greater than the second setup value, to control the switching valve to switch the flow of the cooling water to the radiator cooling water path, and wherein the switching control means is operable, when the temperature of the exhaust valve area detected by the exhaust valve area temperature detection means is greater than the given temperature, in the state in which the switching valve is switched to the first cooling water path, to control the switching valve to switch the flow of the cooling water to the heater core cooling water path and the radiator cooling water path.

According to this feature, when the temperature of the exhaust valve area detected by the exhaust valve area temperature detection means is greater than the given temperature, in the state in which the switching valve is switched to lead the cooling water to the first cooling water path, the switching control means operates to control the switching valve to switch the flow of the cooling water to the heater core cooling water path and the radiator cooling water path, so that it is possible to cool the cooling water in the heater core cooling water path, and increase the flow rate of the cooling water toward the radiator cooling water path so as to additionally cool the cooling water in the radiator cooling water. This makes it possible to more reliably lower the temperature of the cooling water circulated through the engine, thereby more reliably suppressing the temperature rise in the exhaust valve area.

Preferably, in the engine cooling apparatus of the present invention, the exhaust valve area temperature detection means is operable to detect or estimate a temperature of an area between ones of a plurality of the exhaust valves.

According to this feature, the exhaust valve area temperature detection means operates to detect or estimate the temperature of the area between ones of the plurality of exhaust valves. This makes it possible to more accurately detect or estimate the temperature of the exhaust valve area, and thus more accurately perform operation of switching the switching valve.

Preferably, in the engine cooling apparatus of the present invention, the exhaust valve area temperature detection means is operable to estimate the temperature of the exhaust valve area, based on a parameter representing an operating state of the engine.

According to this feature, the exhaust valve area temperature detection means operates to estimate the temperature of the exhaust valve area, based on a parameter representing the operating state of the engine. This makes it possible to detect the temperature of the exhaust valve area, without using a costly temperature sensor.

More preferably, in the above engine cooling apparatus, the exhaust valve area temperature detection means is operable to: calculate a generated heat amount, based on the parameter representing the operating state of the engine; distribute the calculated generated heat amount to a cylinder head and a cylinder block; and estimate the temperature of the exhaust valve area, from the generated heat amount distributed to the cylinder head.

According to this feature, it is possible to more accurately estimate the temperature of the exhaust valve area.

Preferably, in the engine cooling apparatus of the present invention, the first setup value of the temperature of the cooling water, based on which the switching control means controls the switching valve to switch the flow of the cooling water between the first cooling water path and the second cooling water path, is set based on the temperature of the cooling water at start-up of the engine.

According to this feature, it is possible to prevent deterioration in reliability of the engine.

Effect of Invention

The engine cooling apparatus of the present invention can prevent deterioration in reliability of the cylinder head of the engine during cold engine operation.

BRIEF DESCRIPTION OF DRAWINGS

FIG. 3 is a schematic diagram showing a drive mechanism for the switching valve in

FIG. 2.

DESCRIPTION OF EMBODIMENTS

With reference to the drawings, an engine cooling apparatus according to one embodiment of the present invention will now be described. First of all, the overall configuration of the engine cooling apparatus according to this embodiment will be described based on FIG. 1.

Figure 1:
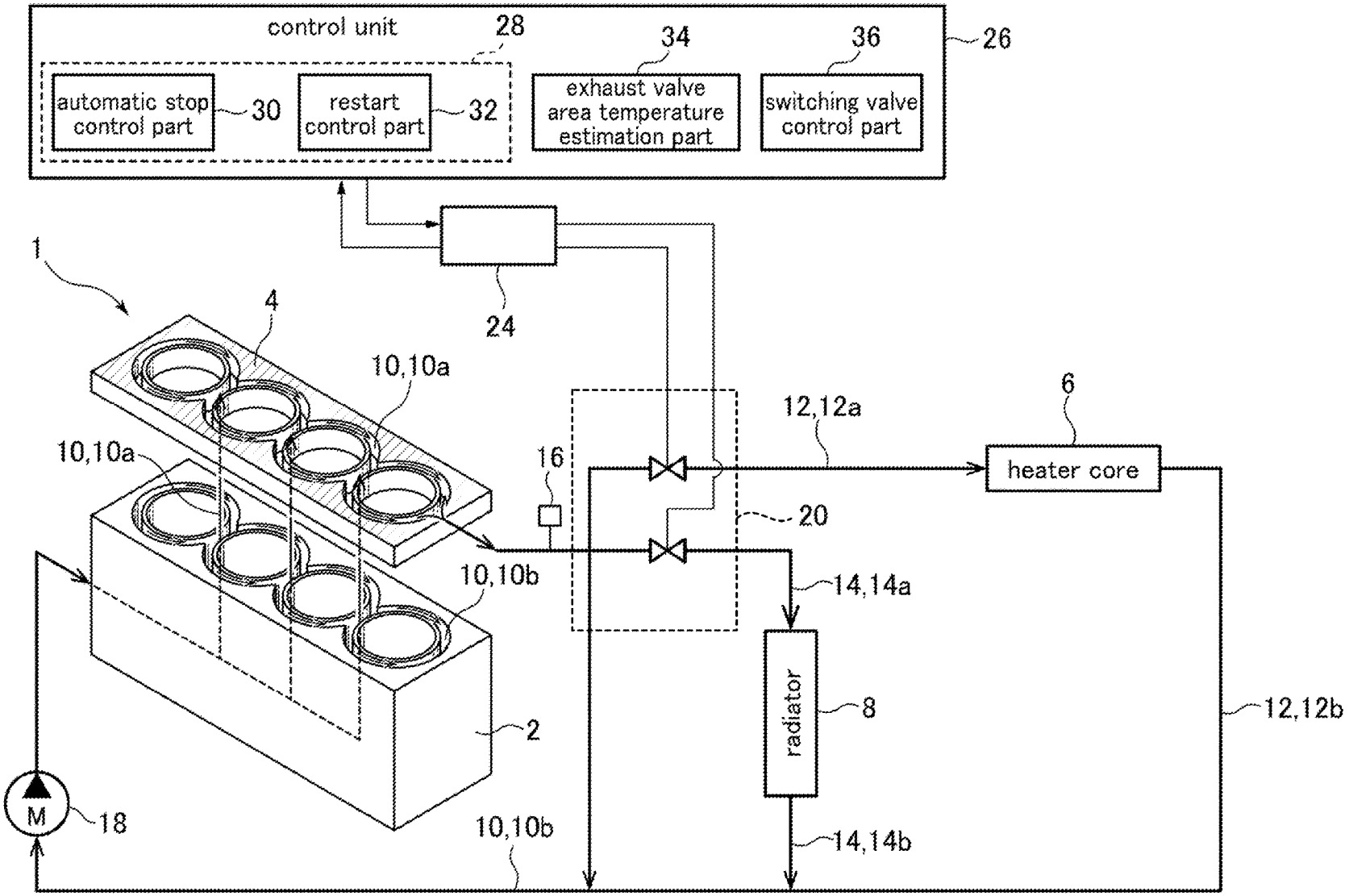
FIG. 1 is an overall configuration diagram showing an engine cooling apparatus according to one embodiment of the present invention.

As shown in FIG. 1, an engine (internal combustion engine) 1 comprises a cylinder block 2 and a cylinder head 4. It should be noted that, although the cylinder block 2 and the cylinder head 4 are separately depicted in FIG. 1, for the sake of illustration, they are actually assembled as an integral structure.

A heater core 6 and a radiator 8 are arranged in the vicinity of the engine 1. Each of the heater core 6 and the radiator 8 is connected to the engine 1 via a cooling water path.

The heater core 6 is a heat exchanger for performing heat exchange with cooling water for cooing the engine 1, and configured to generate hot air to be blown into a passenger compartment of a vehicle, using, as a heating medium, part of heat absorbed by the cooling water when passing through the after-mentioned water jacket 10*a* inside the engine 1.

The radiator 8 is also a heat exchanger for performing heat exchange with the cooling water, and configured to release heat of the cooling water absorbing heat generated by the engine 1, to atmosphere.

The cooling water path includes: an engine cooling water path 10 for circulating the cooling water through the engine 1; a heater core cooling water path 12 for circulating the cooling water between the engine 1 and the heater core 6; and a radiator cooling water path 14 for circulating the cooling water between the engine 1 and the radiator 8.

The engine cooling water path 10 comprises a water jacket 10*a* provided inside the cylinder block 2 and the cylinder head 4 of the engine 1, and an external path 10*b* arranged outside the engine 1 to enable the cooling water to be discharged from an outlet of the engine 1 with respect to the water jacket 10*a* and directly returned to an inlet of engine 1 with respect to the water jacket 10*a*.

The heater core cooling water path 12 comprises an inlet-side path 12*a* for leading the cooling water from the side of the outlet of the engine 1 to an inlet of the heater core 6, and an outlet-side path 12*b* for returning the cooling water from an outlet of the heater core 6 to the side of the inlet of the engine 1.

The radiator cooling water path 14 comprises an inlet-side path 14*a* for leading the cooling water from the side of the outlet of the engine 1 to an inlet of the radiator 8, and an outlet-side path 14*b* for returning the cooling water from an outlet of the radiator 8 to the side of the inlet of the engine 1.

An outlet-side water temperature sensor 16 is provided in the external path 10*b* of the engine cooling water path 10 at a position on the side of the outlet of the engine 1, to detect the temperature of the cooling water. Further, a water pump 18 is provided in the external path 10*b* of the engine cooling water path 10 at a position on the side of the inlet of the engine 1. This water pump 18 is connected to the engine 1, and configured to be rotated in synchronization with rotation of the engine 1. An engine speed of the engine 1 varies, and, accordingly, a pump speed of the water pump 18 varies. This water pump 18 has a built-in inlet-side water temperature sensor.

Figure 2:
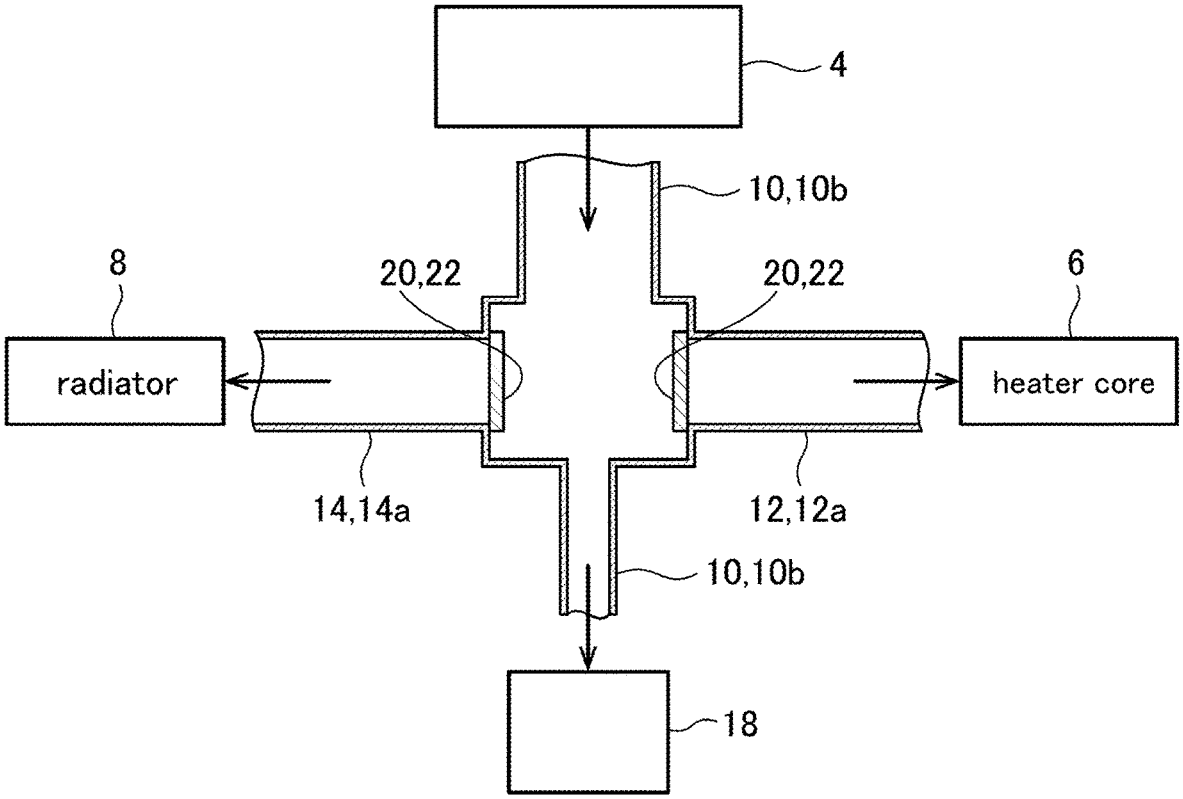
FIG. 2 is a schematic diagram showing a switching valve and paths to be switched by the switching valve, in the engine cooling apparatus according to this embodiment.

As shown in FIGS. 1 and 2, a switching valve 20 is disposed at a connection section which connects the external path 10*b* of the engine cooling water path 10, the inlet-side path 12*a* of the heater core cooling water path 12, and the inlet-side path 14*a* of the radiator cooling water path 14. It should be noted that, although two valve elements are depicted in FIG. 1, the switching valve 20 actually has a single valve element 22, as shown in the sectional views of FIGS. 2 and 4A to 4C.

Figure 3:
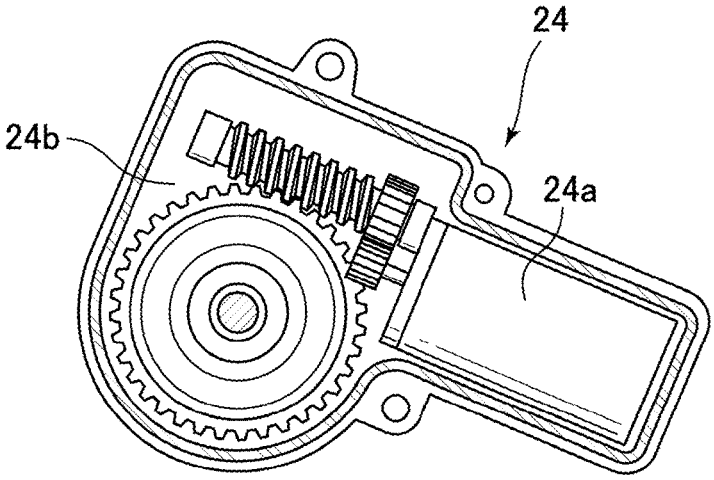

The valve element 22 of the switching valve 20 is configured to be rotationally driven by a DC motor 24, as shown in FIG. 3. The DC motor 24 comprises a motor 24*a*, and a worm gear 24*b* directly connected to a shaft of the motor 24*a*. The above valve element 22 is coupled to a worm wheel of the worm gear 24*b*, such that it is rotationally driven by the worm wheel.

Further, a control unit 26 is provided, as shown in FIG. 1. This control unit 26 comprises an automatic stop control unit 28 for performing the after-mentioned engine automatic stop control. This automatic stop control unit 28 comprises an automatic stop control part 30 for automatically stopping the engine, and a restart control part 32.

The control unit 26 further comprises an exhaust valve area temperature estimation part 34 for estimating the temperature of an exhaust valve area around an exhaust valve of the engine 1, and a switching control part (switching valve control part) 36 for control an opening degree of the switching valve 20.

Next, with reference to FIGS. 4A to 4C, a switching movement (switching operation) of the switching valve 20 will be described. The valve element 22 of the switching valve 20 is formed with two cutouts 22*a*, 22*b* for allowing the cooling water to pass therethrough.

Figure 4A:
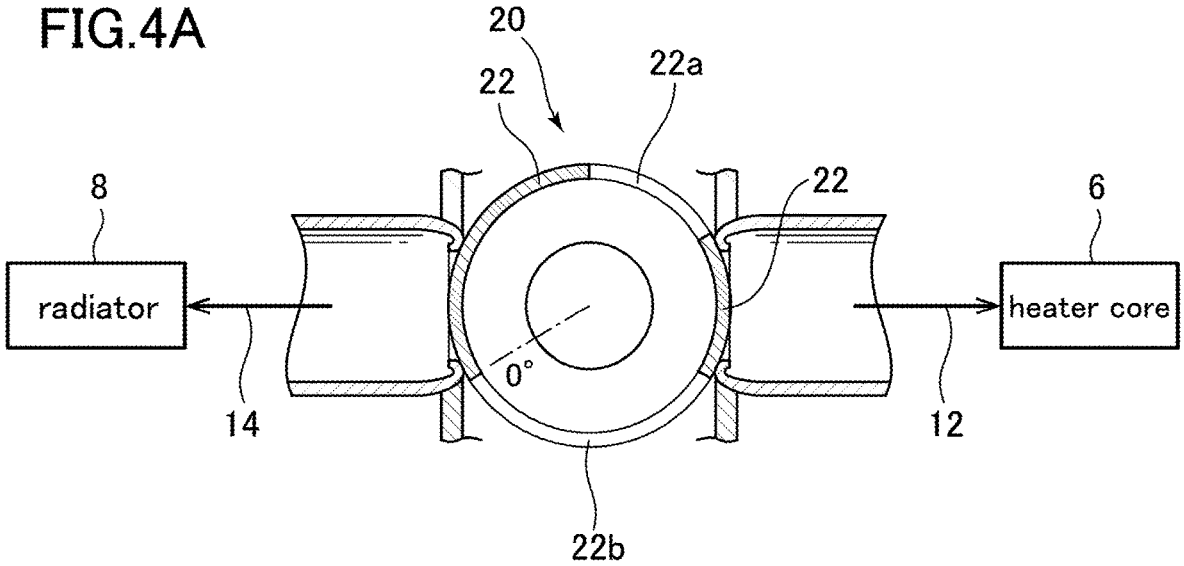
FIG. 4A is a sectional view showing a state in which an opening degree of a valve element of the switching valve in FIG. 2 is 0°.

FIG. 4A shows a state in which the opening degree of the valve element 22 of the switching valve 20 is 0°. At this opening degree, the cooling water for the engine 1 flows through the engine cooling water path 10, while being prevented from flowing through either of the heater core cooling water path 12 and the radiator cooling water path 14. When the switching valve 20 is positioned at this opening angle, the temperature of the cooling water is raised, during cold engine operation such as at start-up of the engine.

Figure 4B:
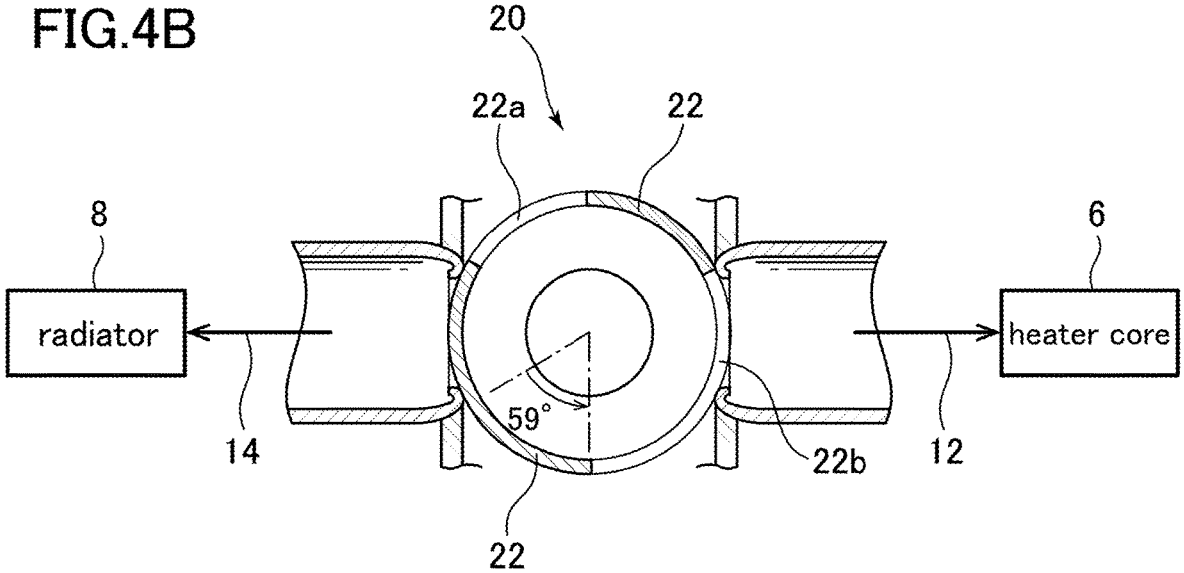
FIG. 4B is a sectional view showing a state in which the opening degree of the valve element of the switching valve in FIG. 2 is 59°.

FIG. 4B shows a state in which the opening degree of the valve element 22 of the switching valve 20 is 59°. At this opening degree, the cooling water for the engine 1 flows through the engine cooling water path 10 and the heater core cooling water path 12, while being prevented from flowing through the radiator cooling water path 14. When the switching valve 20 is positioned at this opening angle, heat is supplied to the heater core, during semi-warm engine operation.

Figure 4C:
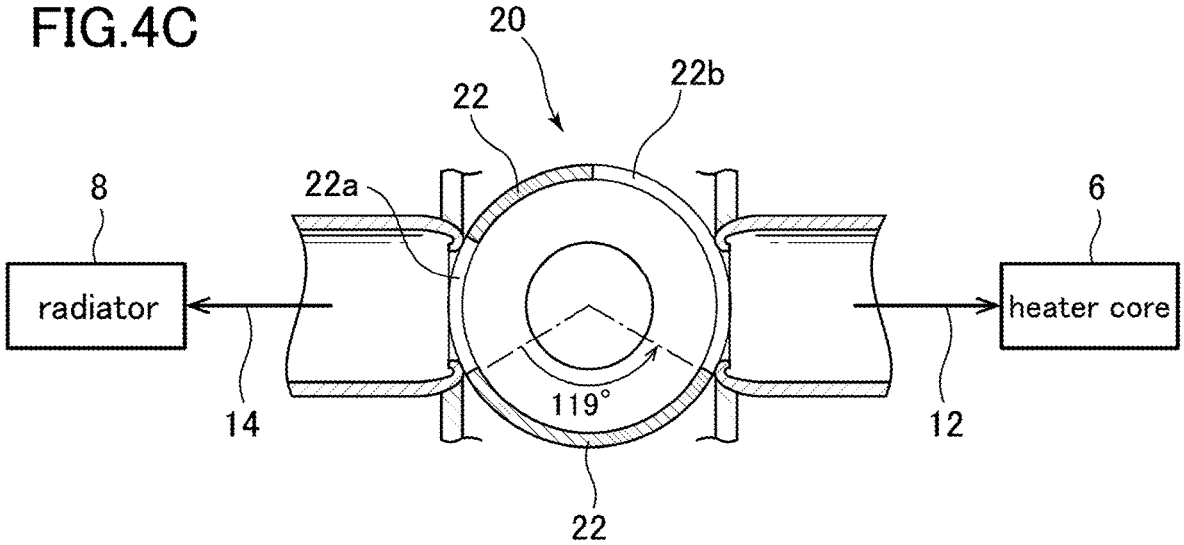
FIG. 4C is a sectional view showing a state in which the opening degree of the valve element of the switching valve in FIG. 2 is 119°.

FIG. 4C shows a state in which the opening degree of the valve element 22 of the switching valve 20 is 119°. At this opening degree, the cooling water for the engine 1 flows through the engine cooling water path 10, the heater core cooling water path 12, and the radiator cooling water path 14. When the switching valve 20 is positioned at this opening angle, it is possible to satisfy both heating by the heater core and cooling by the radiator, during warm engine operation.

Next, the automatic stop control unit 28 in the control unit 26 as shown in FIG. 1 will be described. The engine automatic stop control is referred to as "idle stop control", and is a well-known technique in itself. Therefore, only the outline of the automatic stop control unit 28 will be described here.

First, the automatic stop control part 30 of the automatic stop control unit 28 is operable, during operation of the engine, to determine whether or not a predetermined engine automatic stop condition is satisfied, and, upon satisfaction of the condition, execute control of automatically stopping the engine.

The restart control part 32 of the automatic stop control unit 28 is operable, after the engine is automatically stopped, to determine whether or not a predetermined restart condition is satisfied, and, upon satisfaction of the condition, execute control of automatically restarting the engine.

Here, examples of the automatic stop condition for the automatic stop control part 30 include a condition that the vehicle is in a stopped state, a condition that a relative position of an accelerator pedal is zero, a condition that a brake pedal is depressed, a condition that the engine is operated in a warmed-up state, a condition that a remaining capacity of a battery is equal to or greater than a given value, and a condition that the load of an air conditioner is relatively low. The automatic stop control part 30 is operable, when all of these conditions are met, to determine that the automatic stop condition is satisfied, and execute the automatic stop control.

Examples of the restart condition for the automatic stop control part 30 include a condition that the brake pedal is released, a condition that the accelerator pedal is depressed, a condition that the temperature of the cooling water for the engine becomes less than a given value, a condition that the remaining capacity of the battery is reduced beyond an allowable value, a condition that a period during which the engine is stopped (elapsed time period after the automatic stop) becomes greater than a given automatic stop time period (e.g., 2 minutes), and a condition that it becomes necessary to activate the air conditioner. The restart control part 32 is operable, when at least one of these conditions is met, to determine that the restart condition is satisfied, and execute the restart control.

Even during cold engine operation such as at start-up of the engine, particularly in a situation where the temperature of the cooling water has a minus value at start-up of the engine, the cylinder head is likely to become high temperature, although the cylinder block is maintained at a relatively low temperature. In this case, due to a difference in coefficient of thermal expansion therebetween, the entire engine is deformed into an inverted trapezoidal shape, leading to deterioration in reliability of the engine, in some cases. For this reason, in this embodiment, the temperature of the exhaust valve area of the cylinder head is estimated, as described in detail later. Alternatively, a temperature sensor 40 may be installed to the cylinder head to directly detect the temperature of the exhaust valve area (the temperature of an area between exhaust valves), as illustrated in FIG. 5.

Figure 5:
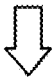
FIG. 5 is a block diagram showing steps to estimate the temperature of an exhaust valve area of the cylinder head.
Figure 5:
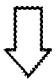
Figure 5:
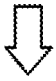
Figure 5:
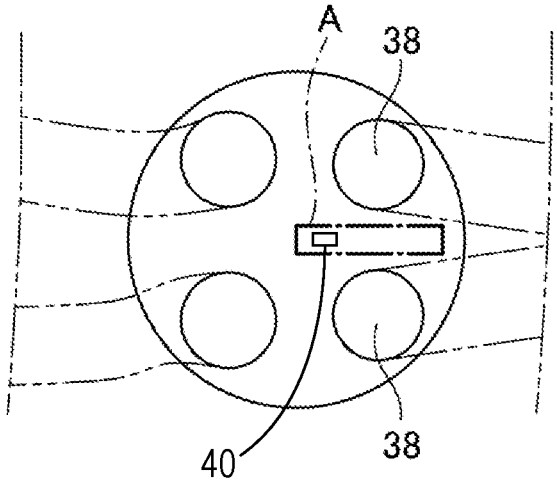

With reference to FIG. 5, steps to estimate the temperature of the exhaust valve area of the cylinder head will be described. As shown in FIG. 5, the exhaust valve area temperature estimation part 34 (shown in FIG. 1) is operable to calculate a generated heat amount in each cylinder, from: an engine speed (rpm); an air charging efficiency (in-cylinder air amount); a fuel injection amount calculated according to engine operating conditions such as the engine speed and the air charging amount; and an ignition timing calculated according to engine operating conditions such as the engine speed and the air charging amount. Then, the generated heat amount in each cylinder is distributed to the cylinder block and the cylinder head. Then, the temperature of the exhaust valve area, specifically, an area between ones of a plurality of exhaust valves 38 (between two exhaust valves 38 in FIG. 5), is estimated from the generated heat amount distributed to the cylinder head. The temperature of the area between the exhaust valves 38 (area designated by A in FIG. 5) can become the highest in the cylinder head, so that it is possible to accurately estimate the amount of thermal deformation in the cylinder head.

Figure 6:
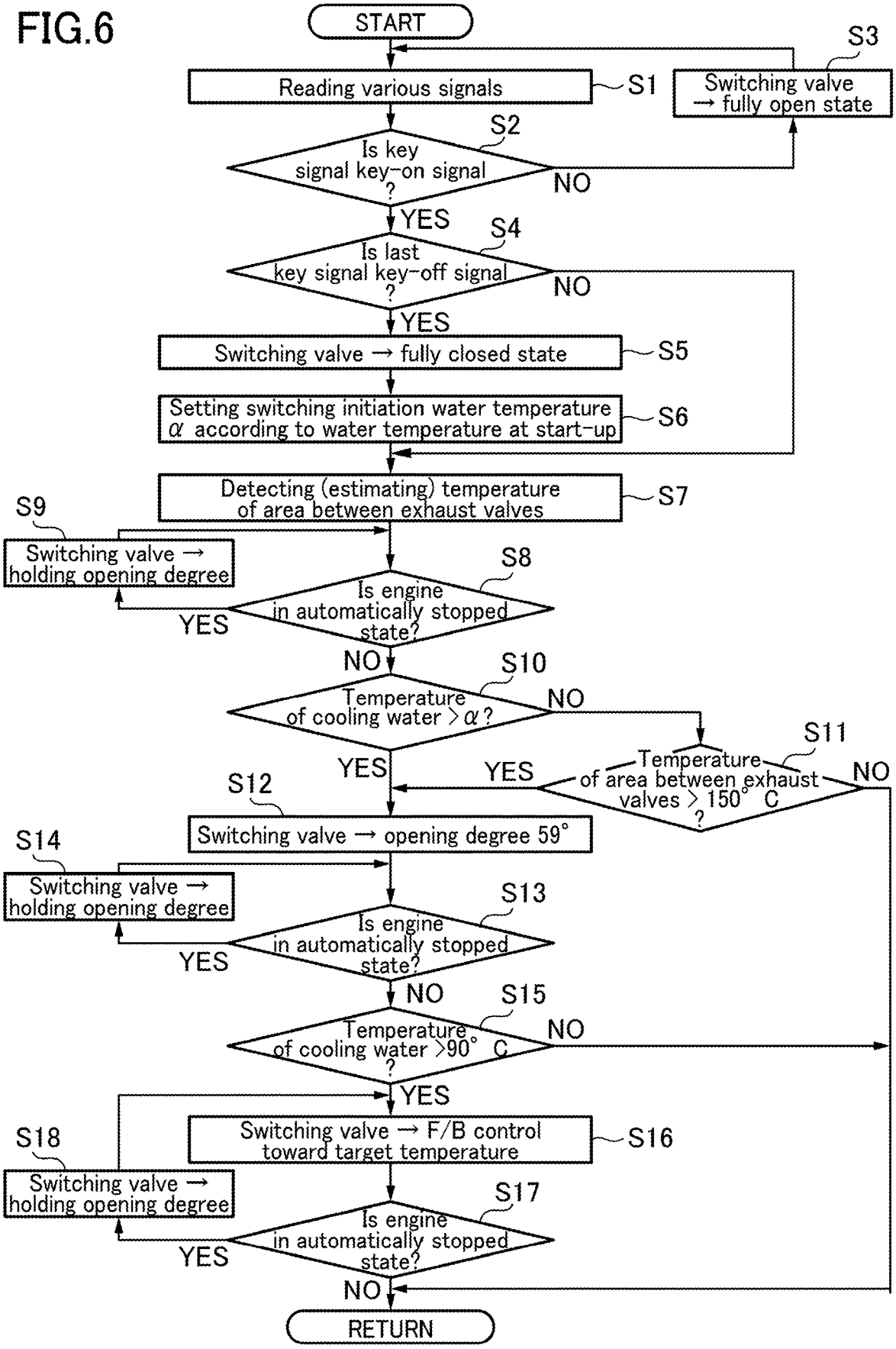
FIG. 6 is a flowchart showing the content of control based on switching of the switching valve in the engine cooling apparatus according to this embodiment.

Next, the details of control during switching operation of the switching valve 20 in the engine control apparatus according to this embodiment will be described based on FIG. 6. In FIG. 6, S denotes each step.

First, in S1, the control unit 26 operates to read, as various signals, a key signal indicative of ON/OFF of an ignition key, a signal indicative of the temperature of the cooling water, and signals necessary to estimate the temperature of the area between the exhaust valves 38, such as the engine speed and the air charging efficiency.

Subsequently, in S2, the control unit 26 operates to determine whether or not the key signal is a key-on signal indicating that the ignition key is in an ON state. When the key signal is determined not to be the key-on signal, the engine has not been started up, and thus the routine proceeds to S3. In the S3, the control unit 26 (switching control part 36) operates to set the switching valve in a fully open state. The fully open state of the switching valve means the state in which the opening degree is 119°, as shown in FIG. 4C, i.e., the state in which the cooling water flows through all of the engine cooling water path 10, the heater core cooling water path 12 and the radiator cooling water path 14.

On the other hand, in the S2, when the key signal is determined to be the key-on signal, the routine proceeds to S4. In the S4, the control unit 26 operates to determine whether or not the determined key-on signal is a first-time key-on signal in the course of execution of the control in the flowchart of FIG. 6, i.e., whether or not the engine is in start-up operation. More specifically, the control unit 26 operates to determine whether or not the key signal (the last key signal) read in the S1 in the immediately-previous processing cycle among repeatedly executed processing cycles each represented by the flowchart in FIG. 6 is a key-off signal indicating that the ignition key is in an OFF state. In the S4, when the last key signal is determined not to be the key-off signal (the last key signal is also determined to be the key-on signal), the key-on signal is continued, so that the after-mentioned processings in S5 and S6 are skipped.

When the key signal is determined, in the S2, to be the key-on signal, and the last key signal is determined, in the S4, to be the key-off signal, the engine is during a cold engine operation after start-up, and thus the routine proceeds to S5. In the S5, the control unit 26 (switching control part 36) operates to set the switching valve in a fully closed state. The fully closed state of the switching valve means the state in which the opening degree is 0°, as shown in FIG. 4A, i.e., the state in which the cooling water flows through the engine cooling water path 10.

Subsequently, the routine proceeds to S6. In the S6, the control unit 26 operates to set a switching initiation water temperature $\alpha$ according to a water temperature at start-up of the engine.

Figure 7:
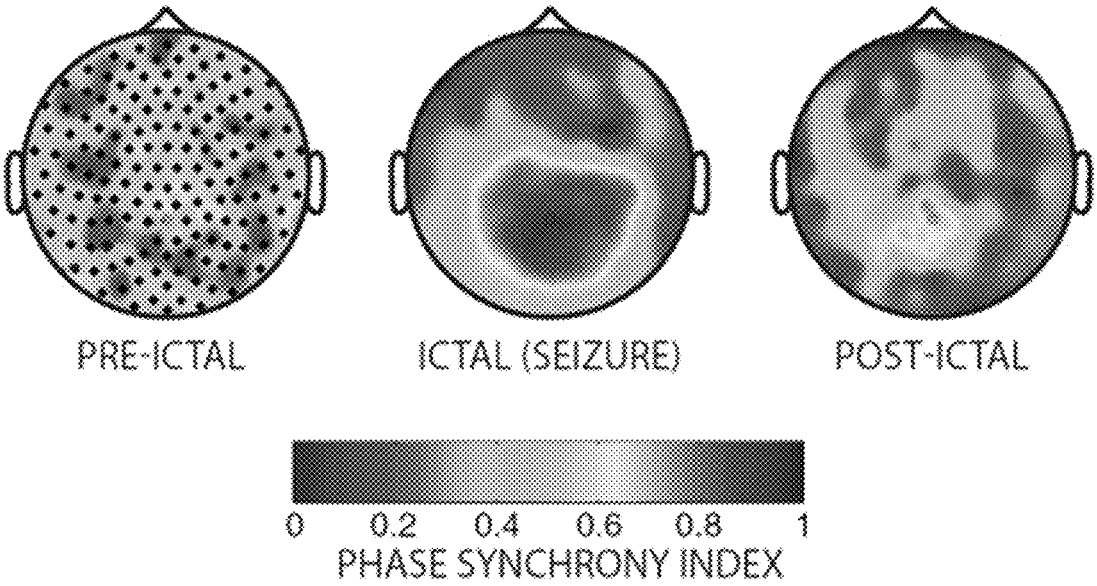
FIG. 7 is a chart showing a relationship between a cooling water temperature at start-up of an engine, and a cooling water temperature as a switching condition of the switching valve.

As shown in FIG. 7, in a situation where the water temperature at the start-up is equal to or higher than −10° C., the switching initiation water temperature $\alpha$ is 50° C. On the other hand, in a situation where the water temperature at the start-up is lower than −10° C., the switching initiation water temperature $\alpha$ becomes lower than 50° C., as shown in FIG. 7. As above, in this embodiment, the switching initiation water temperature $\alpha$ is not a constant value, but is set to vary according to the temperature of the cooling water at the start-up of the engine.

Subsequently, the routine proceeds to S7. In the S7, the control unit 26 (exhaust valve area temperature estimation part 34) operates to estimate the temperature of the area between the exhaust valves. The temperature of the area between the exhaust valves is calculated and estimated by the aforementioned steps in FIG. 5.

Subsequently, the routine proceeds to S7, the control unit 26 operates to determine whether or not the engine is in an automatically stopped state. This determination as to whether or not the engine is in the automatically stopped state is made based on signals from the automatic stop control part 30 and the restart control part 32 of the automatic stop control unit 28.

When the engine is determined to be in the automatically stopped state, the routine proceeds to S9. In the S9, the control unit 26 (switching control part 36) operates to hold (fix) the opening degree of the switching value at a current opening degree.

In this case, the opening degree of the switching value is held in the fully closed state as shown in FIG. 4A.

On the other hand, in the S8, when the engine is determined not to be in the automatically stopped state, the routine proceeds to S10. In the S10, the control unit 26 operates to determine whether or not the temperature of the cooling water is greater than the switching initiation water temperature α (e.g., 50° C.) set in the S6. When the temperature of the cooling water is determined to be equal to or less than the switching initiation water temperature α, the routine proceeds to S11. In the S11, the control unit 26 operates to determine whether or not the temperature of the area between the exhaust valves is greater than a given temperature (e.g., 150° C.). Here, the temperature of the area between the exhaust valves is the temperature estimated in the S7. Alternatively, instead of estimating the temperature of the area between the exhaust valves, the temperature of an area around the exhaust value (the temperature of an area between the exhaust valves) may be detected by a temperature sensor installed to the cylinder head, as mentioned above.

On the other hand, in the S10, when the temperature of the cooling water is determined to be greater than the switching initiation water temperature α, the routine proceeds to S12. In the S12, the control unit 26 (switching control part 36) operates to set the switching valve to 59°. This state in which the opening degree of the switching valve is 59° is the state as shown in FIG. 4B, i.e., the state in which the cooling water flows through the engine cooling water path 10 and the heater core cooling water path 12, while being prevented from flowing through the radiator cooling water path.

In the S11, when the temperature of the area between the exhaust valves is determined to be greater than a given temperature (e.g., 150° C.), the routine also proceeds to the S12. In the S12, the control unit 26 (switching control part 36) also operates to set the switching valve to 59°. On the other hand, when the temperature of the area between the exhaust valves is not determined to be greater than a given temperature (e.g., 150° C.), the routine returns to the S1.

As above, in this embodiment, when the temperature of the area between the exhaust valves is greater than a given value (e.g., 150° C.) even in the situation where the engine is in a cold state, i.e., the temperature of the cooling water is equal to or less than the switching initiation water temperature α (e.g., 50° C.), the opening degree of the switching valve is changed to 59° so as to lead the cooling water to the heater core cooling water path 12, so that it is possible to lower the temperature of the cooling water.

Subsequently, the routine proceeds to S13. In the S13, the control unit 26 operates to determine whether or not the engine is in the automatically stopped state, as with the S8. When the engine is determined to be in the automatically stopped state, the routine proceeds to S14. In the S14, the control unit 26 (switching control part 36) operates to hold (fix) the opening degree of the switching value at a current opening degree (59°). In this case, the opening degree of the switching value is held at 59° as shown in FIG. 4B.

On the other hand, in the S13, when the engine is determined not to be in the automatically stopped state, the routine proceeds to S15. In the S15, the control unit 26 operates to determine whether or not the temperature of the cooling water is greater than a given temperature α (e.g., 90° C.). When the temperature of the cooling water is determined to be equal to or less than 90° C., the routine returns to the S1. On the other hand, when the temperature of the cooling water is determined to be greater than 90° C., the routine returns to S16.

In the S16, the opening degree of the switching valve is subjected to feedback control so as to enable the temperature of the cooling water to become a given target temperature. In this process, the switching valve 20 is controlled to have an opening degree between 59° (as shown in FIG. 4B) and 119° (as shown in FIG. 4C). As the opening degree of the switching valve 20 becomes larger, the rate of the flow of the cooling water to the radiator cooling water path 14 becomes larger, and, accordingly, the temperature of the cooling water is lowered more largely.

Subsequently, the routine proceeds to S17, the control unit 26 operates to determine whether or not the engine is in the automatically stopped state, as with the S8 and S13. When the engine is determined to be in the automatically stopped state, the routine proceeds to S18. In the S18, the control unit 26 (switching control part 36) operates to hold (fix) the opening degree of the switching value at a current opening degree (the opening degree set through the feedback control in S16). In this case, the opening degree of the switching value is held at the current opening degree.

In the above switching valve control as shown in FIG. 6, during the automatically stopped state, the opening degree of the switching valve is held (fixed) at the current opening degree in the S9, the S14 and the S18. However, this embodiment is not limited thereto. For example, the opening degree of the switching valve may be adjusted by a small amount. In this case, even when the switching operation of the switching value is performed during the automatically stopped state, it is possible to suppress the generation of noise disturbing passengers.

Further, this embodiment has been described based on an example where, when the temperature of the area between the exhaust valves is greater than a given value (e.g., 150° C.) even in the situation where the engine is in a cold state, i.e., the temperature of the cooling water is equal to or less than the switching initiation water temperature α (e.g., 50° C.), the opening degree of the switching valve is changed to 59°, thereby lowering the temperature of the cooling water. However, this embodiment is not limited thereto. For example, as one modification, when the temperature of the area between the exhaust valves is greater than a given value (e.g., 150° C.), the opening degree of the switching valve may be changed to 119° so as to lead the cooling water to the heater core cooling water path 12 and the radiator cooling water path 14, thereby further lowering the temperature of the cooling water.

Next, functions/effects of the engine cooling apparatus according to the above embodiment will be described.

The engine cooling apparatus according to the above embodiment comprises: the engine cooling water path 10 for circulating the cooling water for cooling the engine 1 through the engine 1; the heater core cooling water path 12 for circulating the cooling water through the engine 1 and the heater core 6; and the radiator cooling water path 14 for circulating the cooling water through the engine 1 and the radiator 8, wherein the switching valve control part 36 is operable, when the temperature of the cooling water is equal to or less than, e.g., 50° C. (first setup value), to control the switching valve 20 to switch the flow of the cooling water to the engine cooling water path 10, and, when the temperature of the cooling water is greater than e.g., 50° C. (first setup value), to control the switching valve 20 to switch the flow of the cooling water to the heater core cooling water path 12 and/or the radiator cooling water path 14.

Further, when the temperature of an exhaust valve area (i.e., area around the exhaust valve) is greater than, e.g., 150° C., even in a situation where the temperature of the cooling water is equal to or less than, e.g., 50° C. (first setup value), the switching control part 36 is operable to control the switching valve 24 to switch the flow of the cooling water to the heater core cooling water path 12 and/or the radiator cooling water path 14, thereby cooling the cooling water to lower the temperature of the cooling water.

Thus, in the engine cooling apparatus according to the above embodiment, even in a situation where the temperature of the exhaust valve area becomes a higher temperature than, e.g., 150° C., during cold engine operation in which the cooling water flows through the engine cooling water path 10, the cooling water can be switched to flow through the heater core cooling water path 12 and/or the radiator cooling water path 14, so that it is possible to cool the cooling water through cooling water paths 12, 14. This makes it possible to suppress a temperature rise in the exhaust valve area, thereby preventing deterioration in reliability of the engine.

In the engine cooling apparatus according to the above embodiment, when the temperature of the exhaust valve area becomes a higher temperature than, e.g., 150° C., even in a state in which the switching valve 20 is switched to lead the cooling water to the engine cooling water path 10, the switching control part 36 operates to control the switching valve 20 to switch the flow of the cooling water to the heater core cooling water path 12 to lead the cooling water to the heater core cooling water path 12, so that it is possible to cool the cooling water in the heater core cooling water path 12. This makes it possible to suppress a temperature rise in the exhaust valve area, thereby preventing deterioration in reliability of the engine.

In the engine cooling apparatus according to the above embodiment, the temperature of the area between the exhaust valves is detected or estimated. This makes it possible to more accurately detect or estimate the temperature of the exhaust valve area, and thus more accurately perform operation of switching the switching valve.

In the engine cooling apparatus according to the above embodiment, the temperature of the exhaust valve area is estimated based on a parameter representing the operating state of the engine. This makes it possible to detect the temperature of the exhaust valve area, without using a costly temperature sensor.

In the engine cooling apparatus according to the above embodiment, when engine 1 is automatically stopped by the automatic stop control part 30, the switching control part 36 operates to restrict the switching operation performed by the switching valve 20 for switching among the engine cooling water path 10, the heater core cooling water path 12 and the radiator cooling water path 14, according to the temperature of the cooling water, and the adjustment of the opening degree of the switching valve 20, so that it is possible to suppress the generation of a harsh sound which would otherwise occur during the switching operation of the switching valve 20 when engine 1 is automatically stopped.

In the engine cooling apparatus according to the above embodiment, when engine 1 is automatically stopped by the automatic stop control part 30, the switching control part 36 operates to hold the opening degree of the switching valve 20 in a state before the automatic stop, so that it is possible to suppress the generation of a harsh sound which would otherwise occur during the switching operation of the switching valve 20 when engine 1 is automatically stopped.

In the engine cooling apparatus according to the above embodiment, when a given automatic stop period (e.g., 2 minutes) has elapsed after the engine 1 was automatically stopped, the restart control part 32 operates to restart the engine 1, so that it is possible to reduce the change in temperature of the cooling water so as to prevent a negative influence on the operation of switching among the cooling water paths 10, 12, 14.

In the engine cooling apparatus according to the above embodiment, the switching control part 36 operates to: when the temperature of the cooling water is equal to or less than, e.g., 50° C. (first setup value), control the switching valve 20 to switch the flow of the cooling water to the engine cooling water path 10; when the engine cooling water temperature is greater than the first setup value, and equal to or less than, e.g., 90° C. (second setup value) greater than the first setup value, control the switching valve 20 to switch the flow of the cooling water to the heater core cooling water path 12; and, when the temperature of the cooling water is greater than the second setup value, to control the switching valve 20 to switch the flow of the cooling water to the heater core cooling water path 12 and/or the radiator cooling water path 14, so that it is possible to control the cooling water in an optimal state.

LIST OF REFERENCE CHARACTERS

1: engine
2: cylinder block
4: cylinder head
6: heater core
8: radiator
10: engine cooling water path
12: heater core cooling water path
14: radiator cooling water path
16: outlet-side water temperature sensor
18: water pump
20: switching valve
22: valve element
24: DC motor
26: control unit
28: automatic stop control unit
30: automatic stop control part
32: restart control part
34: exhaust valve area temperature estimation part
36: switching control part
38: exhaust valve

The invention claimed is:

1. An engine cooling apparatus comprising:

a first cooling water path for circulating cooling water through an engine without circulating the cooling water through any heat exchanger of the engine cooling apparatus;

a second cooling water path for circulating the cooling water through the first cooling water path and through at least one heat exchanger of the engine cooling apparatus;

a switching valve for switching a flow of the cooling water between the first cooling water path and the second cooling water path; and a switching controller operable to:

when a temperature of the cooling water detected by a cooling water temperature sensor of the engine cooling apparatus is equal to or less than a first setup value, control the switching valve to switch the flow of the cooling water to the first cooling water path, and when the temperature of the cooling water detected by the cooling water temperature sensor is greater than the first setup value, control the switching valve to switch the flow of the cooling water to the second cooling water path, wherein based on at least one engine operating condition, the switching controller is operable to:

calculate a generated heat amount that is distributed to a cylinder block and a cylinder head of the engine from at least one cylinder of the engine;

estimate a temperature of an exhaust valve area between a plurality of exhaust valves of the cylinder head of the engine based on the calculated generated heat amount; and control the switching valve to switch the flow of the cooling water to the second cooling water path when the estimated temperature of the exhaust valve area between the plurality of exhaust valves is greater than a given temperature in a state where the switching valve is switched to the first cooling water path based on the temperature of the cooling water detected by the cooling water temperature sensor being equal to or less than the first setup value.

2. The engine cooling apparatus as recited in claim 1, wherein the at least one heat exchanger comprises a heater core and a radiator; and wherein the second cooling water path comprises:

a heater core cooling water path for circulating the cooling water between the engine and the heater core; and a radiator cooling water path for circulating the cooling water between the engine and the radiator, wherein the switching controller is operable to:

when the estimated temperature of the exhaust valve area is greater than the given temperature, in the state in which the switching valve is switched to the first cooling water path, control the switching valve to switch the flow of the cooling water to the heater core cooling water path, such that the cooling water flows through the heater core cooling water path and through the first cooling water path, and such that the cooling water does not flow through the radiator cooling water path.

3. The engine cooling apparatus as recited in claim 2, wherein the switching controller is operable to:

when the temperature of the cooling water detected by the cooling water temperature sensor is greater than the first setup value, and equal to or less than a second setup value that is greater than the first setup value, control the switching valve to switch the flow of the cooling water to the heater core cooling water path;

when the temperature of the cooling water detected by the cooling water temperature sensor is greater than the second setup value, control the switching valve to switch the flow of the cooling water to the radiator cooling water path, such that the cooling water flows through the radiator cooling water path and through the first cooling water path, and such that the cooling water does not flow through the heater core cooling water path; and when the estimated temperature of the exhaust valve area is greater than the given temperature, in the state in which the switching valve is switched to the first cooling water path, control the switching valve to switch the flow of the cooling water to the heater core cooling water path and the radiator cooling water path, such that the cooling water flows through the heater core cooling water path, through the radiator cooling water path, and through the first cooling water path.

4. The engine cooling apparatus as recited in claim 1, wherein the at least one engine operating condition includes at least one of an engine speed, an air charging efficiency, a fuel injection amount, and an ignition timing.

5. The engine cooling apparatus as recited in claim 1, wherein the first setup value is set based on the temperature of the cooling water during a start-up of the engine.

6. An engine cooling apparatus comprising:

a first cooling water path for circulating cooling water through an engine without circulating the cooling water through any heat exchanger of the engine cooling apparatus;

a second cooling water path for circulating the cooling water through the first cooling water path and through at least one heat exchanger of the engine cooling apparatus;

a switching valve for switching a flow of the cooling water between the first cooling water path and the second cooling water path; and a switching controller operable to:

when a temperature of the cooling water detected by a cooling water temperature sensor is equal to or less than a first setup value, control the switching valve to switch the flow of the cooling water to the first cooling water path, and when the temperature of the cooling water detected by the cooling water temperature sensor is greater than the first setup value, control the switching valve to switch the flow of the cooling water to the second cooling water path, wherein based on at least one engine operating condition, the switching controller is operable to:

calculate a generated heat amount that is distributed to a cylinder block and a cylinder head of the engine from at least one cylinder of the engine;

estimate a temperature of an exhaust valve area between a plurality of exhaust valves of the cylinder head of the engine based on the calculated generated heat amount; and control the switching valve to switch the flow of the cooling water to the second cooling water path when the estimated temperature of the exhaust valve area between the plurality of exhaust valves is greater than a given temperature in a state where the switching valve is switched to the first cooling water path based on the temperature of the cooling water detected by the cooling water temperature sensor being equal to or less than the first setup value, wherein the cooling water temperature sensor is provided in the first cooling water path at an outlet side of the engine, wherein the first setup value is set based on the temperature of the cooling water during a start-up of the engine, and wherein the first setup value is set to a smaller value when the temperature of the cooling water at the start-up of the engine is less than the given temperature, wherein when the temperature of the cooling water detected by the cooling water temperature sensor is equal to or less than the first setup value and the temperature of the exhaust valve area between the plurality of exhaust valves is equal to or less than the given temperature, the switching controller controls the switching valve to switch the flow of the cooling water to the first cooling water path, and wherein when the temperature of the cooling water detected by the cooling water temperature sensor is equal to or less than the first setup value and the temperature of the exhaust valve area between the plurality of exhaust valves is greater than the given temperature, the switching controller controls the switching valve to switch the flow of the cooling water to the second cooling water path.

7. The engine cooling apparatus as recited in claim 1, further comprising an exhaust valve area temperature sensor installed to the cylinder head to detect the temperature of the exhaust valve area between the plurality of exhaust valves directly.

8. An engine cooling apparatus comprising:

a first cooling water path for circulating cooling water through an engine without circulating the cooling water through any heat exchanger of the engine cooling apparatus;

a second cooling water path for circulating the cooling water through the first cooling water path and through at least one heat exchanger of the engine cooling apparatus;

a switching valve for switching a flow of the cooling water between the first cooling water path and the second cooling water path;

an exhaust valve area temperature sensor installed to a cylinder head of the engine to detect a temperature of an exhaust valve area between a plurality of exhaust valves of the cylinder head; and a switching controller operable to:

when a temperature of the cooling water detected by a cooling water temperature sensor of the engine cooling apparatus is equal to or less than a first setup value, control the switching valve to switch the flow of the cooling water to the first cooling water path, and when the temperature of the cooling water detected by the cooling water temperature sensor is greater than the first setup value, control the switching valve to switch the flow of the cooling water to the second cooling water path, wherein based on at least one engine operating condition, the switching controller is operable to:

determine the temperature of the exhaust valve area via the exhaust valve area temperature sensor; and control the switching valve to switch the flow of the cooling water to the second cooling water path when the determined temperature of the exhaust valve area between the plurality of exhaust valves is greater than a given temperature in a state where the switching valve is switched to the first cooling water path based on the temperature of the cooling water detected by the cooling water temperature sensor being equal to or less than the first setup value.

* * * * *